US007013829B1

(12) United States Patent
Alexander

(10) Patent No.: US 7,013,829 B1
(45) Date of Patent: Mar. 21, 2006

(54) MOBILE HUNTING VESSEL

(76) Inventor: Dennis C. Alexander, P.O. Box 139082, Dallas, TX (US) 75313

( * ) Notice: Subject to any disclaimer, the term of this patent is extended or adjusted under 35 U.S.C. 154(b) by 0 days.

(21) Appl. No.: 10/720,312

(22) Filed: Nov. 24, 2003

(51) Int. Cl.
*B63B 35/00* (2006.01)

(52) U.S. Cl. ..... 114/351; 114/125

(58) Field of Classification Search ..... 114/351, 114/125, 121, 122, 123, 124
See application file for complete search history.

(56) References Cited

U.S. PATENT DOCUMENTS

| | | | | |
|---|---|---|---|---|
| 3,193,852 | A * | 7/1965 | Murrmann | 114/351 |
| 3,503,358 | A | 3/1970 | Moesly | |
| 3,638,257 | A * | 2/1972 | Ernst | 114/351 |
| 4,048,939 | A | 9/1977 | Jones, Jr. | |
| 4,615,289 | A | 10/1986 | Bloxham | |
| 4,825,799 | A * | 5/1989 | Bergeron et al. | 114/351 |
| 4,828,520 | A * | 5/1989 | Baughman et al. | 441/40 |
| 4,854,256 | A * | 8/1989 | Hayashi | 114/61.1 |
| 4,938,722 | A * | 7/1990 | Rizley | 440/6 |
| 5,060,591 | A | 10/1991 | Ciavarra | |
| 5,215,025 | A | 6/1993 | Talmor | |
| 6,029,595 | A | 2/2000 | Bachmann | |
| 6,209,470 | B1 | 4/2001 | Burg | |
| 6,371,041 | B1 * | 4/2002 | Ness | 114/333 |

FOREIGN PATENT DOCUMENTS

| | | |
|---|---|---|
| JP | 59-176186 | 10/1984 |

* cited by examiner

*Primary Examiner*—Stephen Avila
(74) *Attorney, Agent, or Firm*—Kean, Miller, Hawthorne, D'Armond, McCowan & Jarman, LLP

(57) ABSTRACT

A semi-submersible hunting vessel is provided. A hunter can move the vessel to a designated hunting area and partially submerge the vessel to reduce the visibility of the vessel and hunter to flying game. The vessel includes a hull, at least one ballast chamber, a dry chamber, and one or more pumps for filling and evacuating the ballast chamber. In another embodiment, the vessel contains fore and aft ballast chambers for added stabilization. Additionally, the vessel may be equipped with a motor, which vertically adjusts to the level of the water by sliding up or down along one or more float guides, along with camouflaging, such as a canopy or a device for installing natural vegetation.

15 Claims, 12 Drawing Sheets

MOBILE HUNTING VESSEL

CROSS-REFERENCE TO RELATED APPLICATION

Not applicable.

BACKGROUND OF THE INVENTION

1. Field of the Invention

This invention relates generally to a mobile hunting vessel designed to allow a hunter to move the vessel to a designated hunting area and partially submerge the vessel to reduce the visibility of the vessel and hunter to flying game. When hunting activities are concluded, the hunter can refloat the vessel and return to the dock.

2. Description of Related Art

Hunting blinds are commonly used to conceal the presence of hunters from flying game, which are known to have exceptionally keen eyesight. If the flying game detects the presence of any predator, it will often "flare" or veer away from a particular area. For this reason, hunters have devised ways of masking their presence using camouflage, natural vegetation, and stealth.

Concealment of the hunter is especially important when hunting waterfowl, which are naturally attracted to water. Although waterfowl can be hunted in flooded woodland areas, they are commonly hunted over open bodies of water or marshland, thus creating the need for aquatic means of transportation. In the past, hunters have used boats, skiffs, pirogues, or waders to access "pit blinds," which are essentially metal, fiberglass, or wooden "pill boxes" partially submerged beneath the surface of a marsh and covered with native vegetation, so as to blend into the relatively flat and featureless terrain. As game birds come within shooting distance of the blind, the hunters emerge from within by throwing back the native cover to fire upon their prey. Any game birds that fall more than a few feet from a partially submerged blind must be retrieved by boat, by wading into the water, or by a dog.

In addition to the technical problems faced by hunters in pit blinds, hunters often desire to hunt game birds from different locations, which gives rise to the need for additional blinds, and in some cases, additional means of transportation to and from the blind. Furthermore, seasoned game birds often become conditioned to avoid a particular area after being repeatedly fired upon from the same location, thus making it advantageous for hunters to change locations between hunts.

As can be appreciated from the foregoing discussion, the use of traditional hunting blinds involves a lot of equipment, preparation time, and forethought. What is needed is a mobile hunting blind that satisfies the need to conceal the hunter, but at the same time eliminates the need for a separate access vehicle. Specifically, what is needed is a vessel that allows the hunter to drive to a desired location, partially submerge the vessel to reduce visibility to flying birds, and hunt from within the vessel similar to the manner in which one would hunt from a traditional pit blind.

Known prior art consists of U.S. Pat. Nos. 3,503,358; 4,048,939; 4,615,289; 5,060,591; 5,215,025; 6,209,595; and 6,209,470. U.S. Pat. No. 4,615,289 to Bloxham discloses a floating dry dock, which may be submerged by flooding floatation chambers and then refloated by blowing water out of the chambers.

U.S. Pat. No. 5,215,025 to Talmor discloses a boat with an interior ballast chambers along the length of the boat. The chambers can be flooded to give the boat additional stability when needed.

U.S. Pat. No. 3,503,358 to Moesly discloses a longitudinal ballast tank beneath the keel of a boat. Water is transferred between two compartments during acceleration to maintain maximum stability and efficiency from rest to a planing position.

The remaining patents pertain principally to other boat configurations with ballast chambers used to enhance stability. However, none of the above patents utilize submersion or ballast chamber technology in connection with a hunting blind.

OBJECTS OF THE INVENTION

It is an object of the present invention to provide a semi-submersible hunting vessel.

Another object of the present invention is to provide a semi-submersible hunting vessel having one or more ballast chambers.

Another object of the present invention is to provide a semi-submersible hunting vessel with one or more ballast chambers which can be selectively filled or evacuated.

Another object of the present invention is to provide a semi-submersible hunting vessel, which is capable of being easily moved from one location to another.

Another object of the present invention is to provide a semi-submersible hunting vessel that can be moved from one location to another using a motor means.

Another object of the present invention is to provide a semi-submersible hunting vessel with a vertically adjustable motor means.

SUMMARY OF THE INVENTION

A semi-submersible hunting vessel is provided for allowing a hunter to move the vessel to a designated hunting area and partially submerge the vessel to reduce the visibility of the vessel and hunter to flying game. The vessel includes a hull, at least one ballast chamber, a dry chamber, and one or more pumps for filling and evacuating the ballast chamber. In another embodiment, the vessel contains fore and aft ballast chambers for added stabilization. Additionally, the vessel may be equipped with a motor means, which vertically adjusts to the level of the water by sliding up or down along one or more float guides.

In operation, a hunter boards the vessel with guns, ammo, canine retrievers, and other hunting supplies and operates the vessel from a dry chamber. The vessel is moved to a selected hunting location using either paddles or a motor mounted to the rear of the vessel on a motor mount. Once the vessel arrives at the selected hunting location, it is preferably anchored in place using an anchor, outriggers, or the like, depending upon the depth of the water. The vessel is then prepared to take on ballast by activating one or more intake pumps, which supply ballast water to one or more ballast chambers located within the vessel through intake conduits. In one embodiment, the vessel contains fore and aft ballast chambers located on opposite sides of the dry chamber.

As the ballast chamber(s) fills, the weight of the vessel increases, thereby decreasing the amount of freeboard and the visible surface area of the vessel above the waterline. If the vessel contains a motor, the motor may be attached to a motor mount, which is in turn attached to one or more guide rails designed to allow the motor to vertically adjust to the rising water level. When the desired amount of freeboard is achieved or when the ballast chamber(s) is full, the intake pump is turned off and the dry chamber can be prepared for hunting activities. In order to prevent over filling of the ballast chamber(s), one or more float switches may be installed to interrupt power to the intake pump when a certain level of water is achieved.

The dry chamber may be equipped with perimeter grating designed to receive and secure in place natural vegetation. Alternatively, the dry chamber can be equipped with a flip cage, a camouflage canopy, or any other means for concealing the hunters within. The exterior portions of the vessel may also be painted in a camouflage pattern to reduce visibility to flying game.

Once hunting activities are complete, the one or more ballast chambers may be evacuated using one or more evacuation pumps located within the ballast chamber(s). The evacuation pumps are designed to transfer water from the ballast chamber(s) through a series of conduits, which purge the water from the vessel at or above the gunwales. As the ballast chamber(s) is evacuated, the weight of the vessel is reduced, causing it to rise above the water surface. Although the vessel is still mobile when the ballast chamber(s) is completely full, it is easier to maneuver when the ballast chamber(s) are empty.

An alternative embodiment of the invention may include a connecting line between fore and aft ballast chambers to allow for the equalization of ballast water.

Another alternative embodiment of the invention includes novel configurations of the ballast chambers, such as ballast chambers built into a compartmentalized hull or ballast chambers located at various other locations throughout the mobile hunting vessel.

Another alternative embodiment of the invention includes a valve and bilge pump for partially flooding and evacuating the dry chamber to further decrease freeboard.

Another alternative embodiment of the invention includes the addition of custom features, such as a dog ladder for allowing a hunting dog to gain access to the dry chamber, benches, gun racks, ammo boxes, and the like.

These and other objects, advantages, and features of this invention will be apparent from the following description.

DETAILED DESCRIPTION OF THE INVENTION

Figure 1:
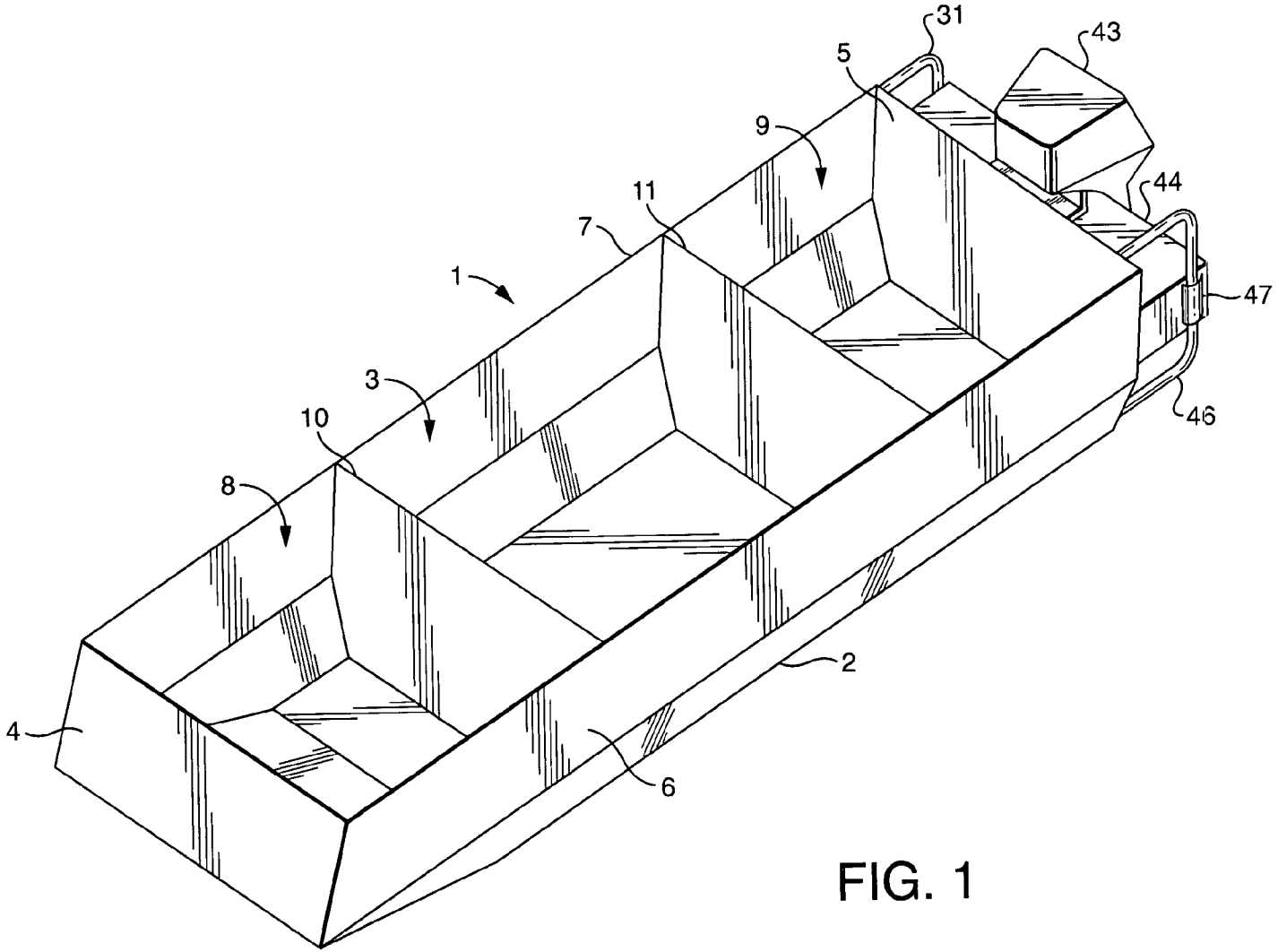
FIG. 1 is a perspective view of an embodiment of the mobile hunting vessel.

With reference to FIGS. 1–10, an embodiment of mobile hunting vessel 1 will now be described. As shown in FIGS. 1–10, mobile hunting vessel 1 comprises a hull 2, a dry chamber 3, and one or more ballast chambers. Hull 2, which comprises bow 4, stern 5, port side 6, and starboard side 7, may be constructed from any suitable material, including without limitation, aluminum or other metal or metal alloy, wood, fiberglass, plastic, and the like. In the embodiment shown, bow 4 and stern 5 are rectilinear in order to maximize the capacity of the ballast chambers.

Figure 3:
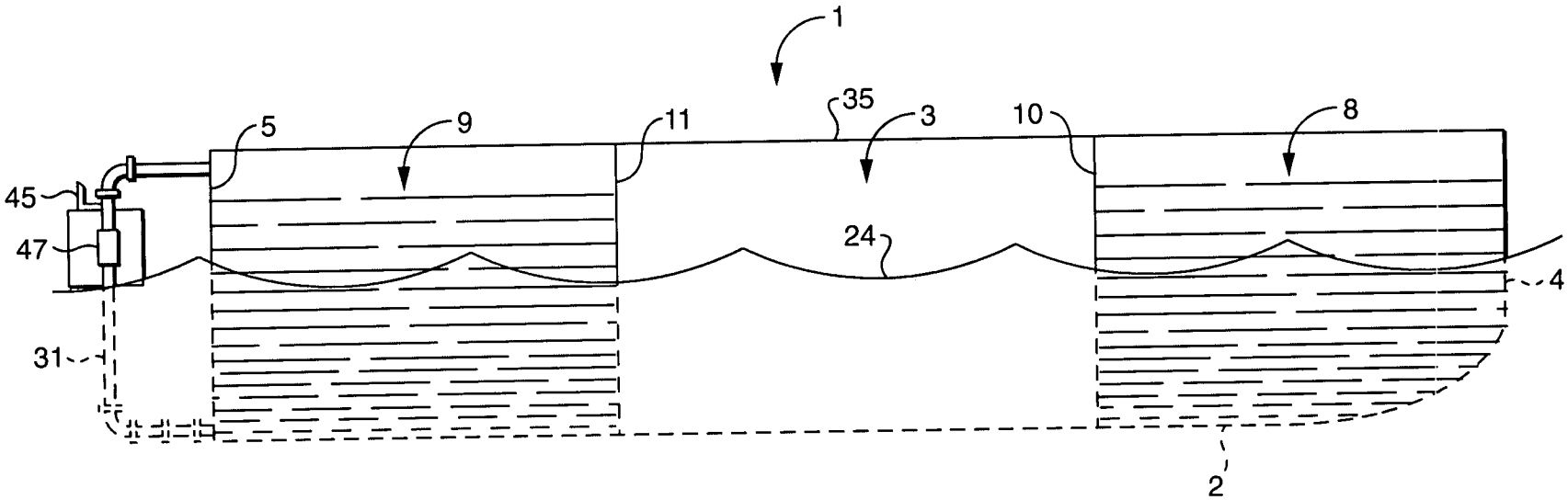
FIG. 3 is an elevation view of an embodiment of the mobile hunting vessel shown in FIG. 2, with ballast chambers partially filled.
Figure 4:
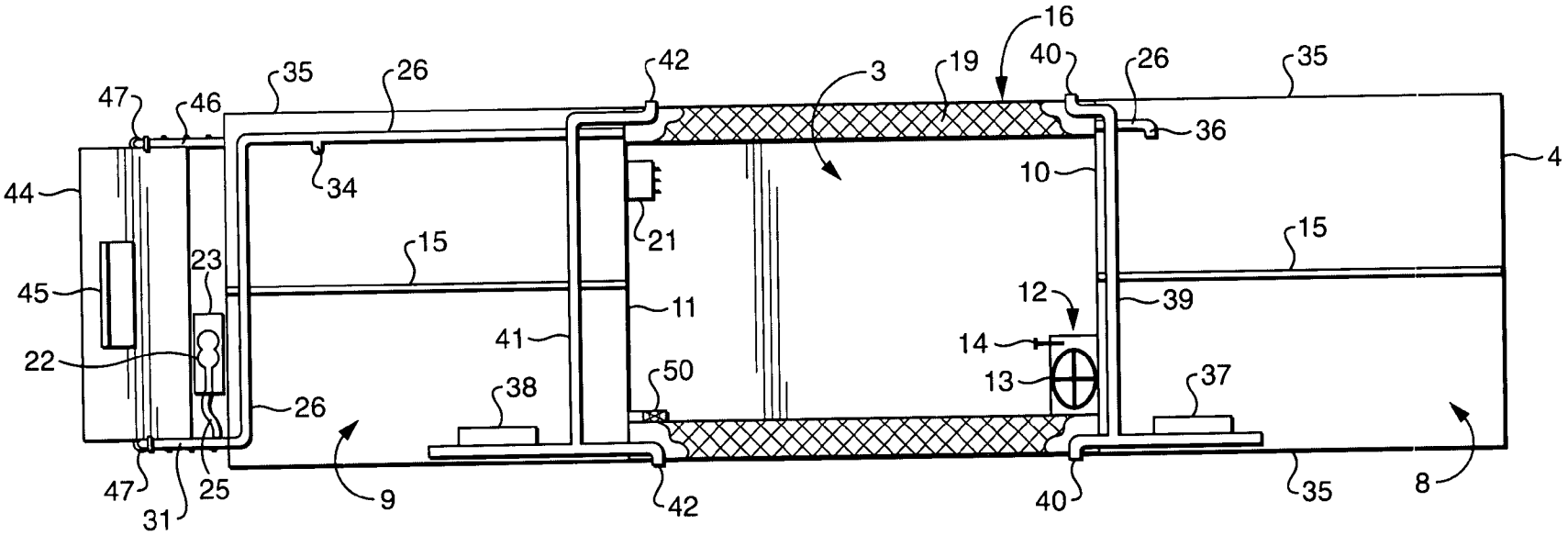
FIG. 4 is a plan view of an embodiment of the mobile hunting vessel depicting the dry chamber and ballast chambers with ballast chamber lids removed.
Figure 5:
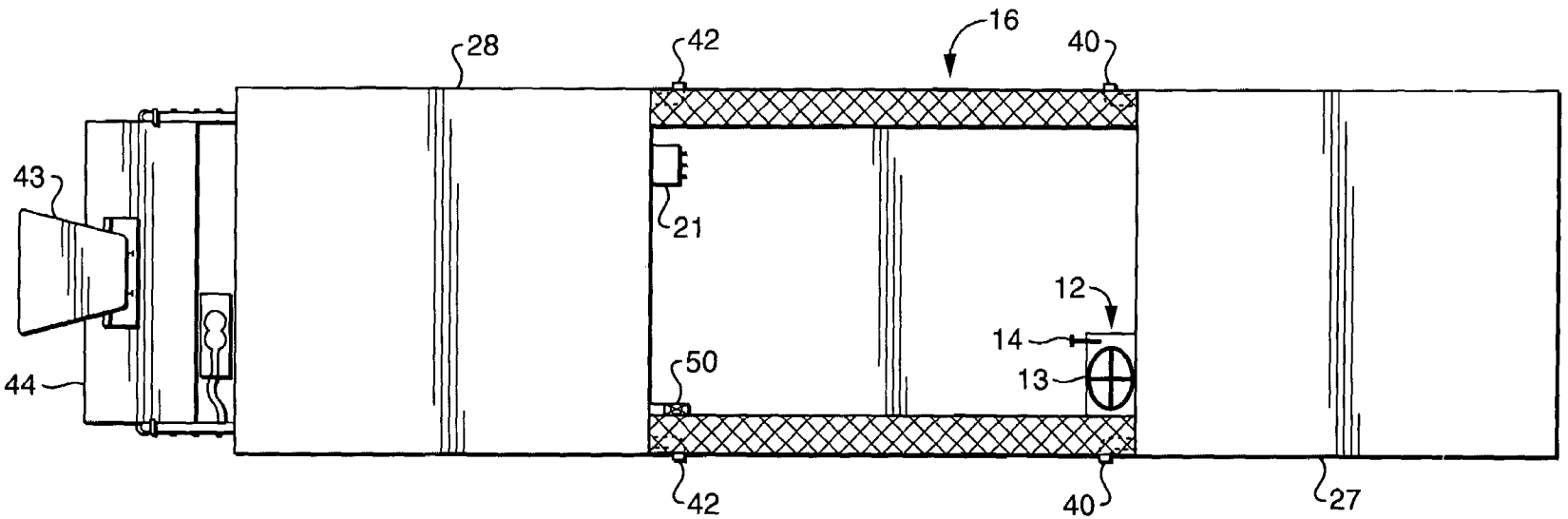
FIG. 5 is a plan view of the embodiment of the mobile hunting vessel shown in FIG. 4, ballast chamber lids in place.

In the embodiment shown in FIGS. 1–6, mobile hunting vessel 1 contains fore ballast chamber 8 and aft ballast chamber 9. Fore ballast chamber 8 is located between bow 4 and fore bulkhead 10, which is positioned athwartships. Aft ballast chamber 9 is located between stern 5 and aft bulkhead 11, which is also positioned athwartships. Fore ballast chamber 8 and aft ballast chamber 9 may be covered to better conceal mobile hunting vessel 1 using fore ballast chamber lid 27 and aft ballast chamber lid 28, as shown in FIG. 5.

Both fore ballast chamber 8 and aft ballast chamber 9 may contain baffling means 15, which is designed to reduce turbulence and promote stability of the water within the ballast chambers. Baffling means 15 is shown in FIG. 4 as a substantially vertical panel between bow 4 and fore bulkhead 10, and between aft bulkhead 11 and stern 5. Alternative embodiments involve the use of other baffling means 15 known in the art, including without limitation the use of multiple vertically arranged baffles, multiple horizontally spaced baffles, a combination of both, a honeycombed baffling structure, or any structure that will reduce turbulence and promote stability of the water within the ballast chambers.

Figure 8:
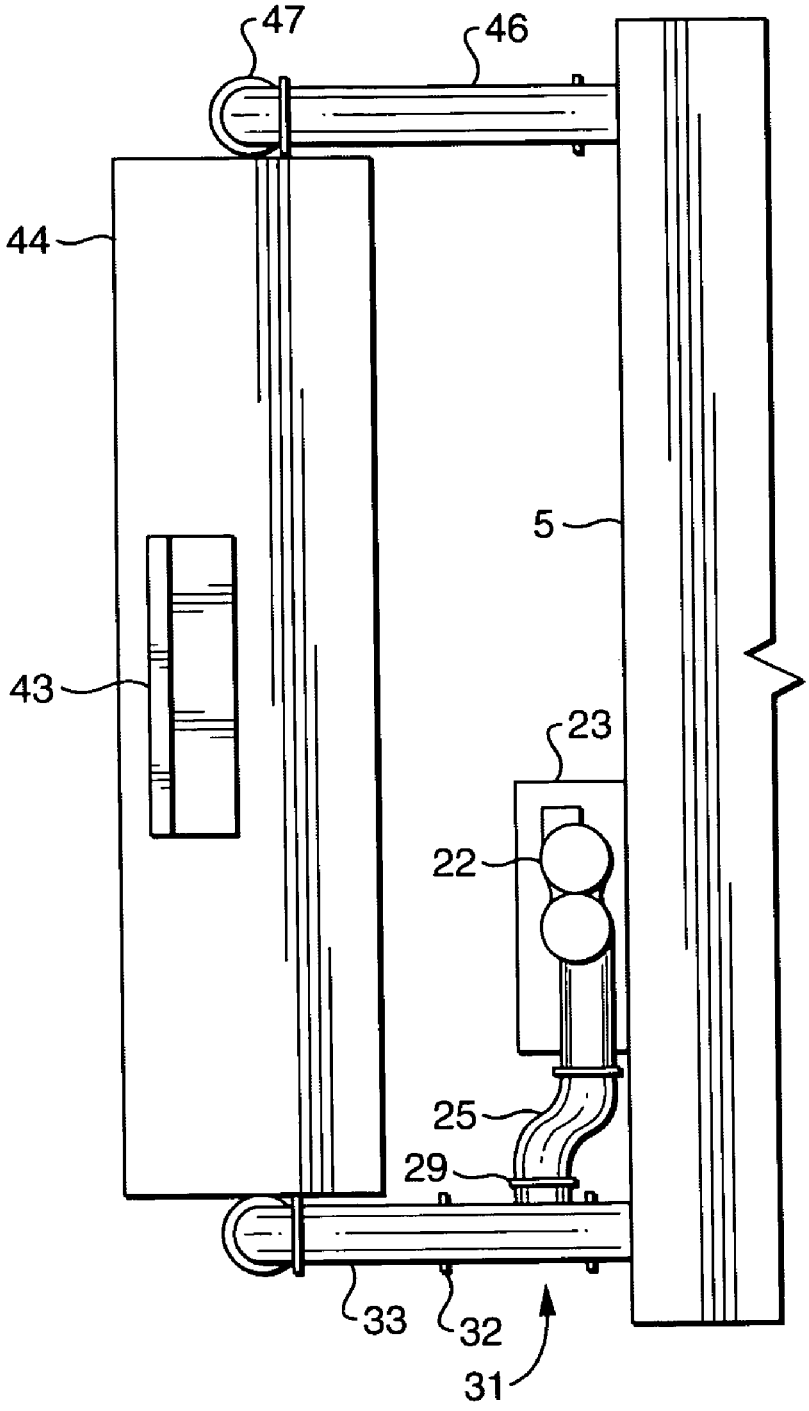
FIG. 8 is a plan view of the embodiment of the invention shown in FIG. 7, further depicting motor mount and intake pump support.
Figure 9:
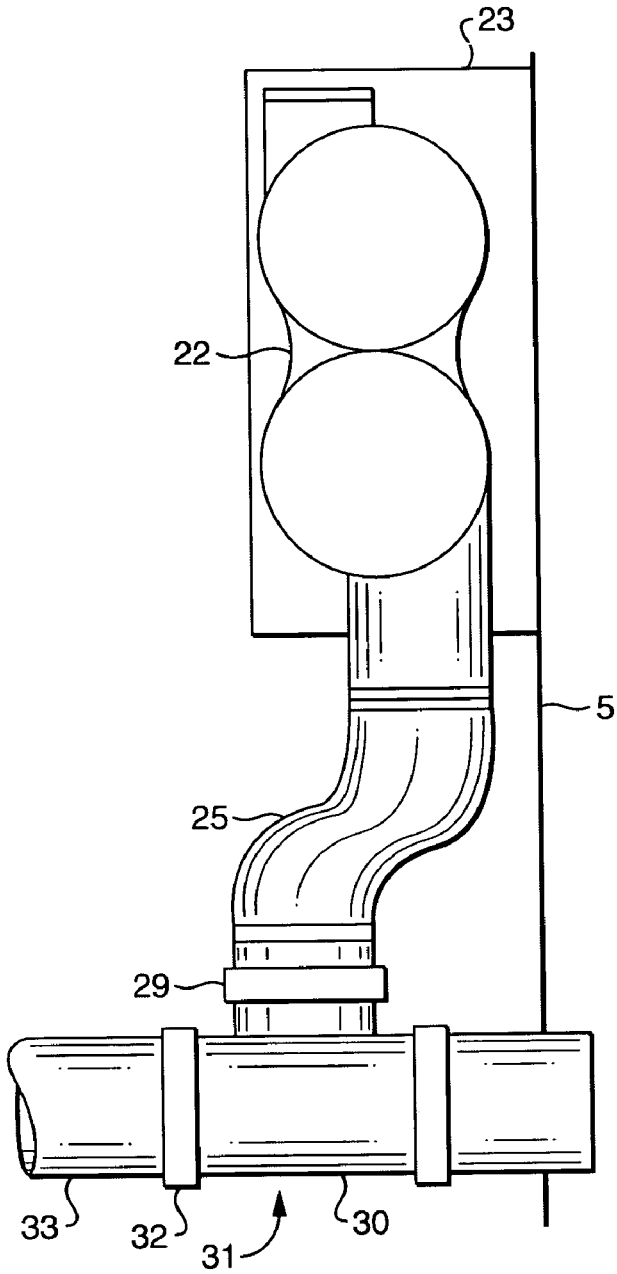
FIG. 9 is a plan view of the intake pump and intake pump support, complete with intake conduit and flexible hose.

Fore ballast chamber 8 and aft ballast chamber 9 are filled using intake pump 22, which may be mounted atop intake pump mount 23 at stern 5 as shown in FIGS. 4 and 8. Intake pump 22 draws water from at or below water surface 24 and routes water through intake hose 25 to intake conduit 26, thereby filling fore ballast chamber 8 and aft ballast chamber 9.

Referring to FIGS. 4, 7, 8, and 9, intake hose 25 attaches intake pump 22 to intake coupling 29, which may be located on the lower portion 30 of right guide member 31. Lower portion 30 is fabricated using metal piping, but may be formed from other materials commonly known in the art. Lower portion 30 projects through stern 5 and is coupled to intake conduit 26 on the interior of stern 5. Although water may fill upper portion 33 of right guide member 31 by moving through socket weld 32, water will not flow through upper portion 33 due to the sealed connection of upper portion 33 to stern 5. In the alternative, intake hose 25 could be attached to left guide member 46 in the same manner described herein.

As shown in FIG. 4, intake conduit 26 rises vertically from inside aft ballast chamber 9 and empties through aft intake discharge 34 into aft ballast chamber 9 at a point near gunwale 35. In the embodiment shown in FIG. 4, intake conduit 26 may additionally be routed to fore ballast chamber 8, where water is discharged near gunwale 35 via fore intake discharge 36.

In operation, intake pump 22 may be activated by a hunter to begin drawing water from at or below water surface 24, which water is routed through intake hose 25, through lower portion 30, and into intake conduit 26. As the water discharges into the ballast chambers through aft ballast discharge 34 and fore ballast discharge 36, the weight of mobile hunting vessel 1 increases, thus forcing hull 2 further below water surface 24 and increasing the amount of freeboard (space between gunwale 35 and water surface 24).

It will be readily appreciated by those skilled in the art that the location of intake pump 22 near the bottom of stern 5 will serve to gradually increase the amount of hydraulic head pressure at intake pump 22 as mobile hunting vessel 1 takes on ballast water and sinks below water surface 24. Additionally, the amount of freeboard desired by the hunter can be achieved by increasing or decreasing the amount of ballast water in the ballast chambers. Of course, appropriate safety mechanisms known to those in the art, such as floating switches (not shown) and the like, could be installed to deactivate intake pump 22 when a certain maximum level of ballast water is achieved in the ballast tanks. Similar safety mechanisms could be used to deactivate intake pump 22 when a certain minimum freeboard is surpassed.

As shown in FIGS. 1–6, dry chamber 3 is located between fore bulkhead 10 and aft bulkhead 11, thus defining an interior dry area to allow hunters to hunt flying game from within. In addition to providing a submersible chamber from which hunters may hunt flying prey, dry chamber 3 houses control panel 12, which may contain common boating features, such as steering means 13 and throttle 14, gauges (not shown), and the like. Control panel 12 may also contain pump switches 21, or pump switches 21 may be located separately within dry chamber 3 as shown in FIG. 4. Additionally, dry chamber 3 may house other amenities necessary for the comfort of hunters and/or necessary for the hunting of flying game, such as benches or chairs for sitting, gun racks, ammunition storage containers, and camouflaging means 16.

Figure 6:
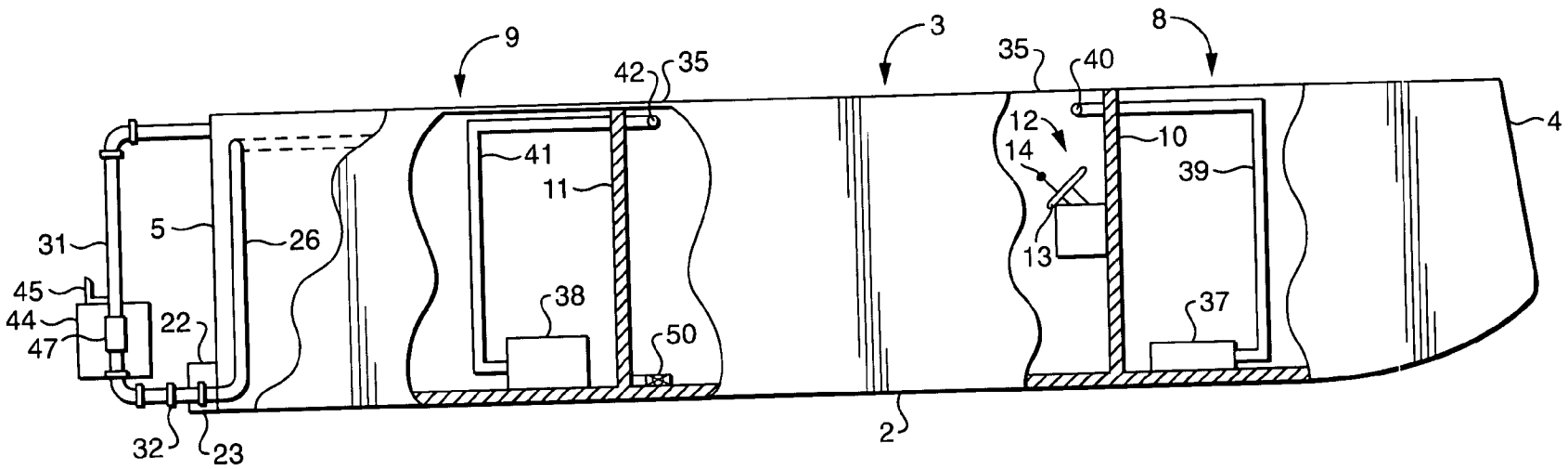
FIG. 6 is an elevation view of an embodiment of the mobile hunting vessel showing evacuation pump and evacuation conduit details.

If desired by the hunter, dry chamber 3 may be partially flooded in order to increase the amount of freeboard by temporarily opening valve 50, which may be located near the intersection of aft bulkhead 11 and the floor of dry chamber 3. By opening valve 50 as shown in FIGS. 4–6, ballast water from aft ballast chamber 9 could be allowed to flow into dry chamber 3. If so desired, valve 50 could be located at the intersection of fore bulkhead 10 and the floor of dry chamber 3 in order to utilize ballast water from fore ballast chamber 8. If further desired, two valves 50 could be installed on mobile hunting vessel 1, one at fore bulkhead 10 and the other at aft bulkhead 11 to allow flooding of dry chamber 3 using ballast water from both fore ballast chamber 8 and aft ballast chamber 9.

When the hunter desires to evacuate ballast water from dry chamber 3, a bilge pump (not shown) or other evacuation means may be necessary. In the alternative, the hunter could first evacuate ballast water from fore ballast chamber 8 and aft ballast chamber 9, then open valve 50 to allow water to flow into aft ballast chamber 9 (if valve 50 is located on aft bulkhead 11) due to the resulting head pressure.

In order to ensure that fore ballast chamber 8 and aft ballast chamber 9 contain substantially the same amount of water and more importantly, to ensure stability of mobile hunting vessel 1, equalizing means (not shown) may be installed between fore ballast chamber 8 and aft ballast chamber 9. Equalizing means may include one or more pipes running along the floor of dry chamber 3 between fore bulkhead 10 and aft bulkhead 11 to fluidly connect fore ballast chamber 8 and aft ballast chamber 9.

Figure 11:
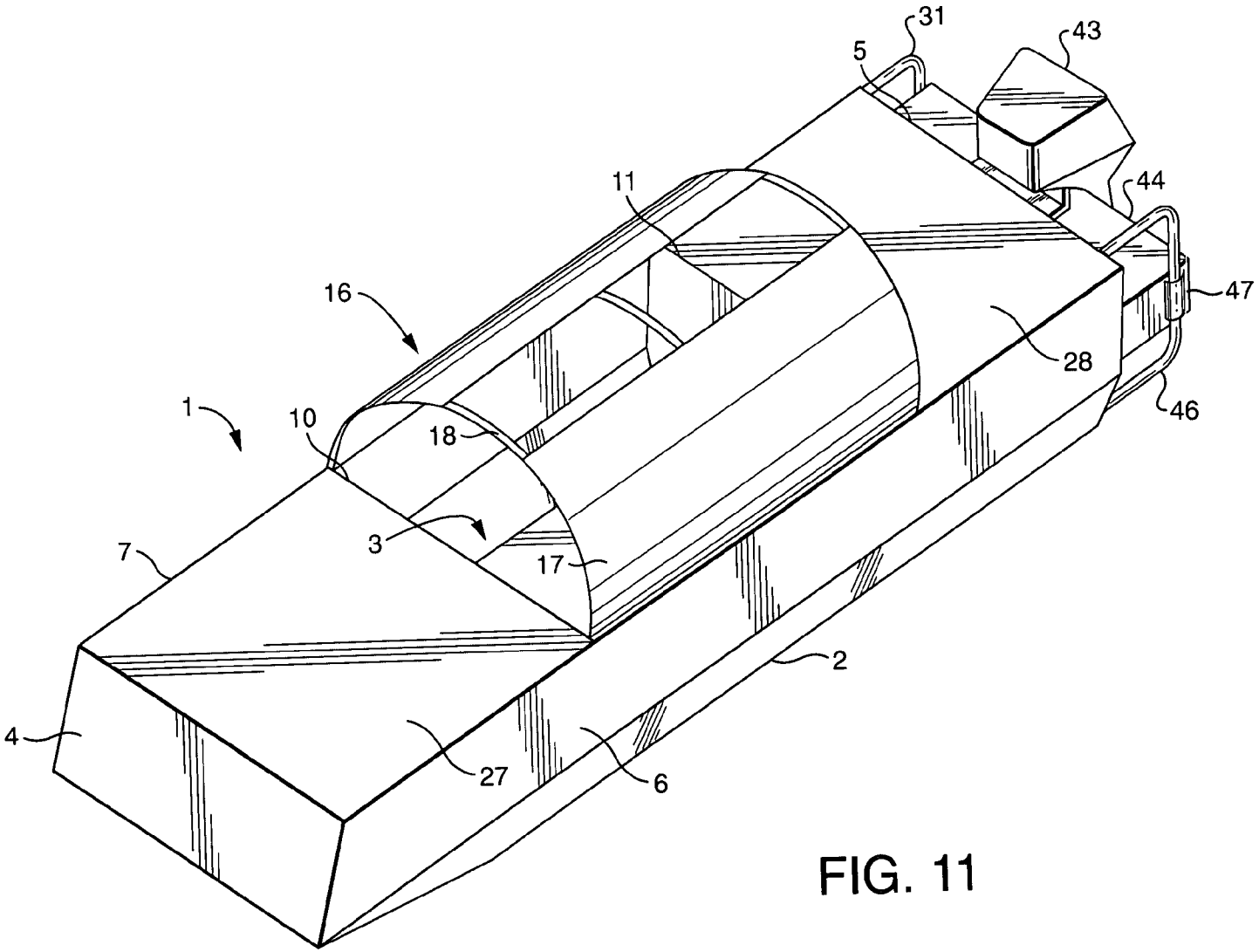
FIG. 11 is a perspective view of the mobile hunting vessel with camouflaging means in place.
Figure 12:
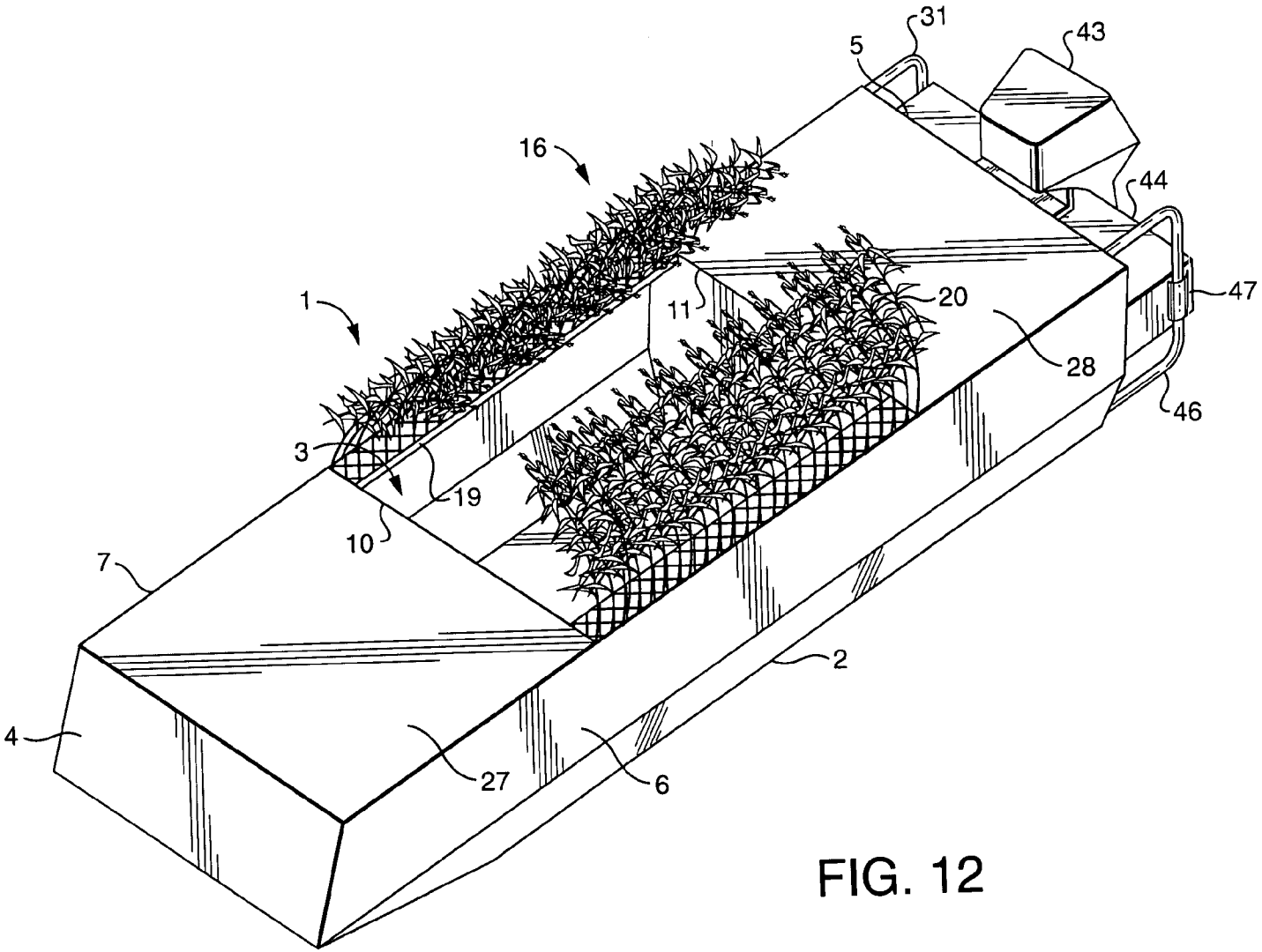
FIG. 12 is a perspective view of the mobile hunting vessel with an alternative camouflaging means in place.

In one embodiment, camouflaging means 16 may include canopy 17 and canopy mounting means 18 for erecting canopy 17 as shown in FIG. 11. Canopy mounting means 18 may be fashioned from any material sturdy enough to hold canopy 17 above dry chamber 3. As shown in FIG. 11, mounting means 18 may be simply a series of arcs or semicircles connected from port side 6 of dry chamber 3 to starboard side 7 of dry chamber 3. The arcs or semicircles can be fashioned from PVC or metal piping, wood, or other materials known in the art. Camouflaging means 16 may also be grating 19 for receiving and securing in place natural vegetation 20, as shown in FIG. 12.

When the hunter desires to relocate mobile hunting vessel 1 or return to the dock, the ballast chamber(s) can be evacuated using one or more evacuation pumps. In the embodiment shown in FIGS. 4 and 6, mobile hunting vessel 1 utilizes fore evacuation pump 37 and aft evacuation pump 38, which remove ballast water from fore ballast chamber 8 and aft ballast chamber 9 respectively. Fore evacuation pump 37 and aft evacuation pump 38 may be submersible pumps secured to the bottom of fore ballast chamber 8 and aft ballast chamber 9. Alternatively, fore evacuation pump 37 and aft evacuation pump 38 may be any other type of pump adapted to transfer water from one location to another location.

Fore evacuation pump 37 is adapted to route water from fore ballast chamber 8 through fore evacuation conduit 39 to fore evacuation discharge 40, which is located near the intersection of fore bulkhead 10 and gunwale 35. Similarly, aft evacuation pump 38 routes ballast water through aft evacuation conduit 41 to aft evacuation discharge 42, which is located near the intersection of aft bulkhead 11 and gunwale 35.

It will be appreciated by those skilled in the art that fore ballast chamber 8 and aft ballast chamber 9 may be consolidated into a single ballast chamber or expanded into three or more ballast chambers. For example, mobile hunting vessel 1 could contain a double hull, with the space between the innermost hull and the outer hull serving as the ballast chamber. Alternatively, mobile hunting vessel 1 could contain multiple ballast chambers distributed throughout hull 2 or on top of hull 2 above the gunwales 35, in an arrangement to both decrease freeboard while at the same time promoting stability. In this embodiment, a series of pipes or other means could be employed to connect each ballast tank in order to promote equilibrium between the tanks and stability of the vessel as a whole. In addition, different configurations of fore bulkhead 10 and aft bulkhead 11 are also contemplated by the invention.

It will further be appreciated by those skilled in the art that a single pump could perform the functions of filling and evacuating all ballast chambers. For example, a single pump could be located within one of the ballast chambers and configured to pump water from outside hull 2 to each of the ballast chambers. Once the ballast chambers are full, the single pump could be reconfigured (e.g., by turning valves or by reversing pump flow) to expel water from the ballast chamber(s) to the open water body.

Figure 7:
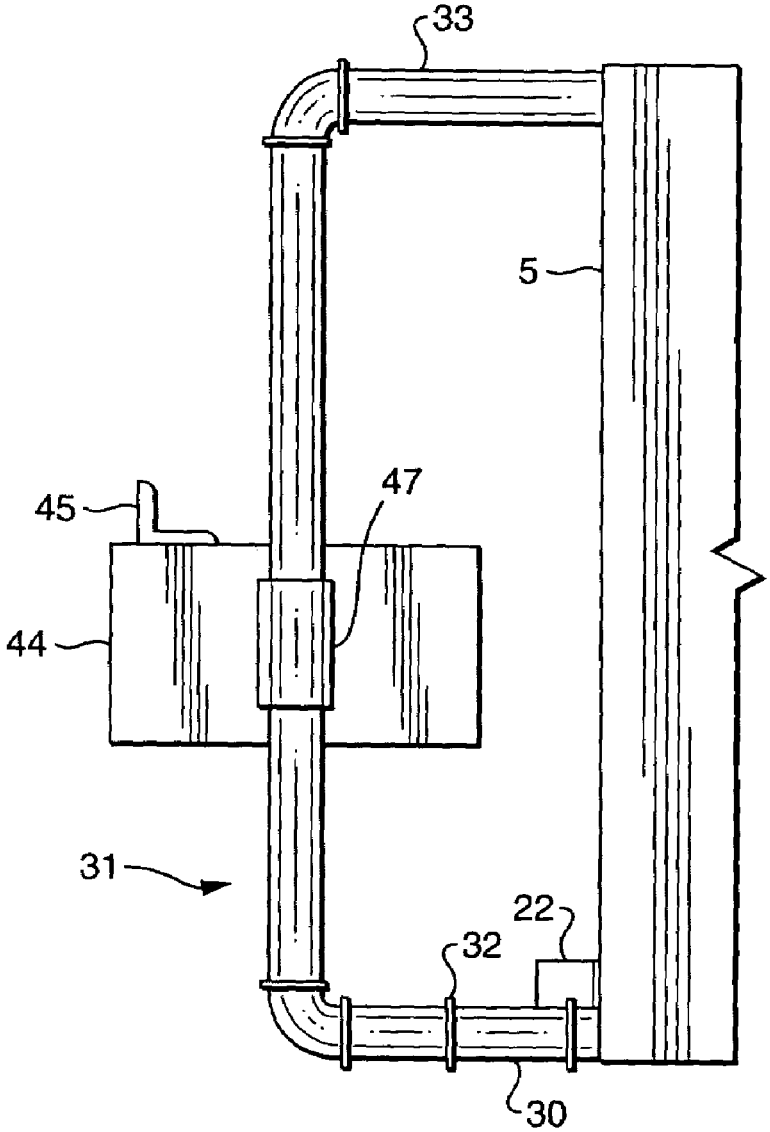
FIG. 7 is an elevation view of an embodiment of the invention showing a motor float attached to guide members.

As shown in FIGS. 1–7 and 10, mobile hunting vessel 1 may be equipped with motor 43, which may be mounted on flotation member 44 using motor mount 45. Motor 43 may be any marine motor that is capable of attaching to flotation member 44, including but not limited to an outboard motor. Motor mount 45 may take on any number of forms, but is shown in FIG. 7 as a piece of angle iron designed to receive and hold motor 43 using traditional motor mounting means, such as screw clamps, bolts, and the like.

Figure 2:
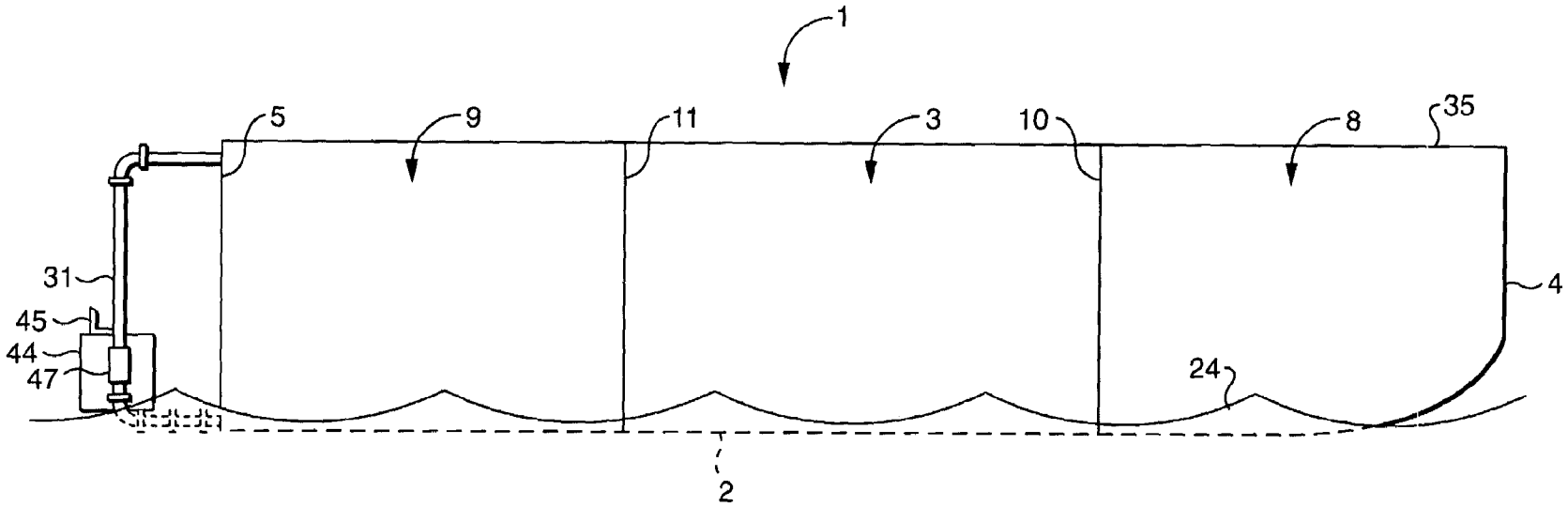
FIG. 2 is an elevation view of one embodiment of the mobile hunting vessel with empty ballast chambers and depicting a motor mount and guide rails.

As best illustrated in FIGS. 2 and 3, flotation member 44 allows motor 43 to adjust to the level of water surface 24 due to the attachment of floatation member 44 to right guide member 31 and left guide member 46. At opposing ends of flotation member 44 are rigidly attached bushings 47, which are designed to slide vertically along right guide member 31 and left guide member 46, respectively. Bushings 47 may be attached to flotation member 44 using any mechanical attachment means known to those skilled in the art, including without limitation welds and nut-and-bolt connections.

Figure 10:
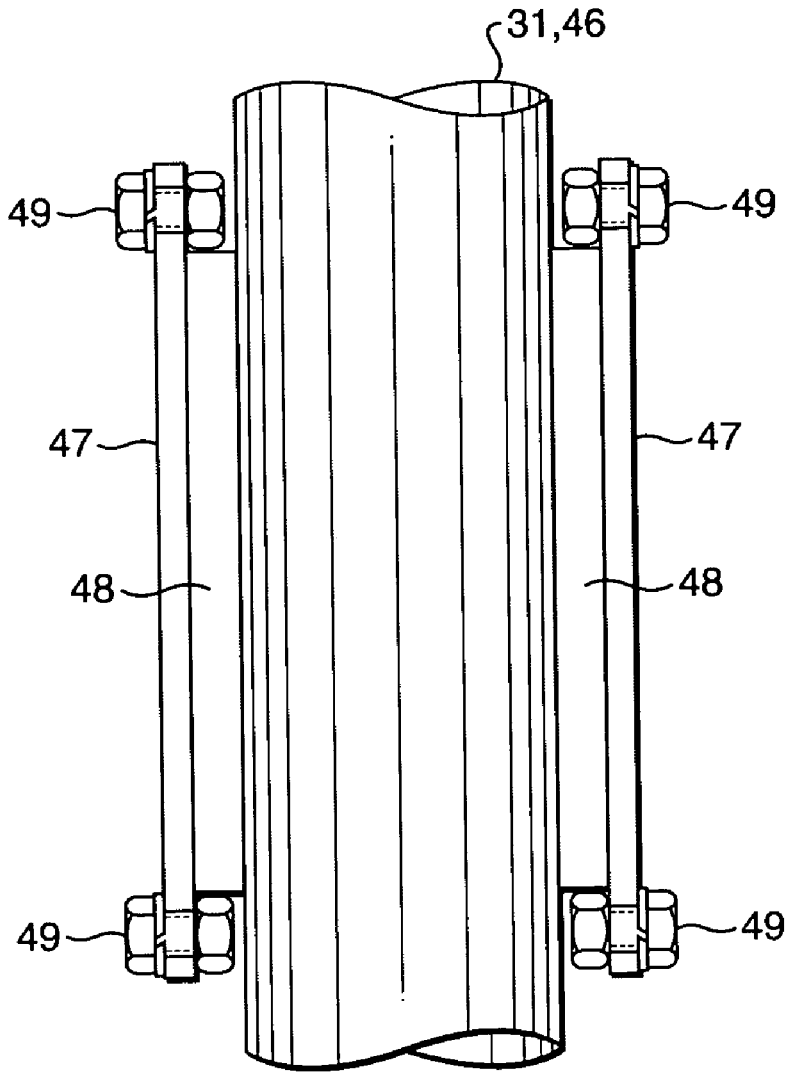
FIG. 10 is a cutaway elevation view of the motor floatation guide, bushing, and guide member.

As shown in FIG. 10, bushings 47 form a sleeve about left and right guide members 31 and 46. Bushings 47 may be packed with packing material 48, which may be a lubricant, a Teflon sleeve or the like, in order to maintain the slideability of bushing 47 along left and right guide members 31 and 46. Securing means 49 may be attached to bushing 47 as shown in FIG. 10 for purposes of securing packing material 48 within bushing 47.

In an alternative embodiment, bushing 47 may be split vertically along its length in order to allow for the removal of flotation member 44 from left and right guide members 31 and 46 and for the installation or replacement of packing material 48. In this embodiment, the two sections of bushing 47 may be connected using securing means 49, which may be a hinge on one side and a latch on the opposing side, a nut and bolt arrangement (FIG. 10) whereby each side contains a tongue which overlaps the opposing side, and other means commonly known in the art. In this particular embodiment, securing means 49 serves the dual purpose of securing bushing 47 fast about left and right guide members 31 and 46 and holding packing material 48 in position between bushing 47 and left and right guide members 31 and 46.

The operation of the embodiment of mobile hunting vessel 1 shown in FIGS. 1–10 will now be described. The hunter enters the boat and pilots the boat to a desired hunting location using motor 43 or paddles, if motor 43 is not desired by the hunter. Alternatively, mobile hunting vessel 1 may be towed by another vessel to a desired hunting location. When the hunter is ready to submerge mobile hunting vessel 1, he or she activates intake pump 22, thereby causing water to be drawn from outside hull 2 through intake pump 22, through intake hose 25 and into lower portion 30. Lower portion 30 protrudes through stern 5 where it is coupled to intake conduit 26 on the inner side. Water is directed through conduit 26 and discharged into aft ballast chamber 9 and fore ballast chamber 8 through aft intake discharge 34 and fore intake discharge 36.

As ballast water fills fore ballast chamber 8 and aft ballast chamber 9, mobile hunting vessel 1 sinks lower in the water, until a minimum freeboard is achieved. Of course the hunter is free to vary the amount of freeboard to suit hunting conditions. In order to increase freeboard, less ballast water is pumped into fore ballast chamber 8 and aft ballast chamber 9. In order to decrease freeboard, additional ballast water is pumped into fore ballast chamber 8 and aft ballast chamber 9, until both chambers are full. If the hunter wishes to further decrease the amount of freeboard, the hunter may additionally open valve 50 and flood dry chamber 3 using water from either fore ballast chamber 8, aft ballast chamber 9, or both, depending on the location of valve 50. Once dry chamber 3 is flooded to a point desired by the hunter, additional ballast water can be pumped into fore ballast chamber 8 and aft ballast chamber 9 to decrease freeboard to an acceptable level and further minimize the amount of surface area of mobile hunting vessel 1 above water surface 24.

Once mobile hunting vessel 1 is submerged to a point acceptable by the hunter, the hunter can install camouflaging means 16, which may include canopy 17 and canopy mounting means 18, natural vegetation attached to grating 19, or other forms of camouflage known to those skilled in the art. Alternatively, camouflaging means 16 may be installed prior to submerging mobile hunting vessel 1 or prior to leaving the dock.

After hunting activities have concluded and the hunter wishes to return to dry land, fore ballast chamber 8, aft ballast chamber 9, and if necessary, dry chamber 3 can be evacuated using fore evacuation pump 37 and aft evacuation pump 38. A separate bilge pump may be necessary to evacuate remaining water from dry chamber 3.

There are, of course, other alternate embodiments that are obvious from the foregoing descriptions of the invention, which are intended to be included within the scope of the invention, as defined by the following claims.

I claim:

1. A mobile hunting vessel comprising:

a) a hull;

b) a first ballast chamber;

c) an intake pumping means for delivering water into said first ballast chamber;

d) an evacuation means for evacuating water from said first ballast chamber;

e) a dry chamber located within said hull, said dry chamber adapted to allow a hunter to hunt from within said dry chamber while partially disposed below the water surface; and f) a valve connecting said first ballast chamber and said dry chamber, wherein said valve may be selectively opened to flood said dry chamber.

2. A mobile hunting vessel comprising:

a) a hull, said hull comprising a bow and a stern;

b) a fore ballast chamber located within said hull near said bow;

c) an aft ballast chamber located within said hull near said stern;

d) an intake pumping means for delivering water into said fore ballast chamber and said aft ballast chamber;

e) an evacuation means for evacuating water from said fore ballast chamber and said aft ballast chamber;

f) a dry chamber located within said hull, said dry chamber adapted to allow a hunter to hunt from within said dry chamber while partially disposed below the water surface; and g) a valve connecting said aft ballast chamber and said dry chamber, wherein said valve may be selectively opened to flood said dry chamber.

3. A mobile hunting vessel comprising:

a) a hull, said hull comprising a bow and a stern;

b) a fore ballast chamber located within said hull near said bow;

c) an aft ballast chamber located within said hull near said stern;

d) an intake pumping means for delivering water into said fore ballast chamber and said aft ballast chamber;

e) an evacuation means for evacuating water from said fore ballast chamber and said aft ballast chamber;

f) a dry chamber located within said hull, said dry chamber adapted to allow a hunter to hunt from within said dry chamber while partially disposed below the water surface; and g) a valve connecting said fore ballast chamber and said dry chamber, wherein said valve may be selectively opened to flood said dry chamber.

4. A mobile hunting vessel comprising:

a) a hull;

b) a first ballast chamber;

c) an intake pumping means for delivering water into said first ballast chamber;

d) an evacuation means for evacuating water from said first ballast chamber;

e) a dry chamber located within said hull, said dry chamber adapted to allow a hunter to hunt from within said dry chamber while partially disposed below the water surface;

f) a motor; and g) a valve connecting said first ballast chamber and said dry chamber, wherein said valve may be selectively opened to flood said dry chamber.

5. A mobile hunting vessel comprising:

a) a hull, said hull comprising a bow and a stern;

b) a fore ballast chamber located within said hull near said bow;

c) an aft ballast chamber located within said hull near said stern;

d) an intake pumping means for delivering water into said fore ballast chamber and said aft ballast chamber;

e) an evacuation means for evacuating water from said fore ballast chamber and said aft ballast chamber;

f) a dry chamber located within said hull, said dry chamber adapted to allow a hunter to hunt from within said dry chamber while partially disposed below the water surface; and g) a motor.

6. The mobile bunting vessel of claim 5, wherein said motor vertically adjusts to the level of said water surface.

7. The mobile hunting vessel of claim 5, wherein said fore ballast chamber and said aft ballast chamber are in fluid communication.

8. The mobile hunting vessel of claim 5, wherein said intake pumping means fills said fore ballast chamber and said aft ballast chamber, and said evacuation means evacuates said water from said fore ballast chamber and said aft ballast chamber.

9. The mobile hunting vessel of claim 5, said mobile hunting vessel further comprising a camouflaging means.

10. The mobile hunting vessel of claim 5, further comprising a valve connecting said aft ballast chamber and said dry chamber, wherein said valve may be selectively opened to flood said dry chamber.

11. Mobile hunting vessel of claim 5, further comprising a valve connecting said fore ballast chamber and said dry chamber, wherein said valve may be selectively opened to flood said dry chamber.

12. A method for hunting game animals, said method comprising the steps of:

(1) providing a mobile hunting vessel, said mobile hunting vessel comprising (a) a hull;

(b) a first ballast chamber;

(c) an intake pumping means for delivering water into said first ballast chamber;

(d) an evacuation means for evacuating water from said first ballast chamber; and (e) a dry chamber located within said hull;

(2) moving said mobile hunting vessel to a desired hunting location;

(3) partially submerging said hunting vessel by filling said first ballast chamber with said water; and (4) hunting said game animals from within said dry chamber.

13. The method as described in claim 12, wherein said mobile hunting vessel further comprises a motor.

14. A method for hunting game animals, said method comprising the steps of:

(1) providing a mobile hunting vessel, said mobile bunting vessel comprising (a) a hull;

(b) a fore ballast chamber;

(c) an aft ballast chamber, (d) an intake pumping means for delivering water into said fore ballast chamber and said aft ballast chamber;

(e) an evacuation means for evacuating water from said fore ballast chamber and said aft ballast chamber; and (f) a dry chamber located within said hull;

(2) moving said mobile hunting vessel to a desired hunting location;

(3) partially submerging said hunting vessel by filling said fore ballast chamber and said aft ballast chamber with said water; and hunting said game animals from within said dry chamber.

15. The method as described in claim 14, wherein said mobile hunting vessel further comprises a motor.

* * * * *